US009681731B2

(12) United States Patent
Jo et al.

(10) Patent No.: US 9,681,731 B2
(45) Date of Patent: Jun. 20, 2017

(54) ROTARY DISPENSER-TYPE COSMETICS CONTAINER

(71) Applicant: YONWOO CO., LTD., Incheon (KR)

(72) Inventors: Hae-Lyong Jo, Incheon (KR); Seo-Hui Jung, Incheon (KR); Cheol-Ho Jang, Incheon (KR); Hyun-Suk Lee, Incheon (KR); Joong-cho Kook, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/892,180

(22) PCT Filed: Apr. 28, 2014

(86) PCT No.: PCT/KR2014/003715

§ 371 (c)(1),
(2) Date: Nov. 18, 2015

(87) PCT Pub. No.: WO2014/189213

PCT Pub. Date: Nov. 27, 2014

(65) Prior Publication Data

US 2016/0088921 A1 Mar. 31, 2016

(30) Foreign Application Priority Data

May 21, 2013 (KR) ..... 10-2013-0057210

(51) Int. Cl.
*B05B 11/00* (2006.01)
*A45D 40/00* (2006.01)
*A45D 34/00* (2006.01)

(52) U.S. Cl.
CPC ..... *A45D 40/0075* (2013.01); *A45D 34/00* (2013.01); *B05B 11/3052* (2013.01);
(Continued)

(58) Field of Classification Search
CPC ..... A45D 40/0075; A45D 34/00; A45D 2200/055; A45D 2200/051;
(Continued)

(56) References Cited

U.S. PATENT DOCUMENTS 8,308,029 B2 * 11/2012 Ki ..... B05B 11/0027 222/153.13
8,636,177 B1 * 1/2014 Gardiner ..... E05B 1/0069 222/181.3
(Continued)

FOREIGN PATENT DOCUMENTS

KR 10-0435793 B1 6/2004
KR 20-2009-0012158 12/2009
(Continued)

OTHER PUBLICATIONS

Search Report for PCT/KR2014/003715, mailed May 30, 2014.

*Primary Examiner* — Paul R Durand
*Assistant Examiner* — Robert Nichols, II
(74) *Attorney, Agent, or Firm* — Marshall, Gerstein & Borun LLP

(57) ABSTRACT

A rotary dispenser-type cosmetics container in which, when a button part rotates, guide protrusions move along a bottom surface of a pumping guide formed on an inner peripheral surface of the button part and then an ascending and descending member ascends and descends, whereby a pumping action is conducted. Therefore, the container discharges contents in a fixed state in which the height of the button part is not changed, and is thereby capable of preventing contents from unnecessarily leaking due to pressing a button by an external pressure.

6 Claims, 3 Drawing Sheets

(52) U.S. Cl.
CPC .. *A45D 2200/051* (2013.01); *A45D 2200/054* (2013.01); *A45D 2200/055* (2013.01); *B05B 11/0048* (2013.01); *B05B 11/0064* (2013.01); *B05B 11/3023* (2013.01); *B05B 11/3069* (2013.01); *B05B 11/3074* (2013.01)

(58) Field of Classification Search
CPC ..... A45D 2200/054; B05B 11/3023; B05B 11/0064; B05B 11/3052; B05B 11/3069; B05B 11/0048; B05B 11/3074
USPC ..... 222/321.7, 321.8, 256, 309, 173
See application file for complete search history.

(56) References Cited

U.S. PATENT DOCUMENTS

| | | | | |
|---|---|---|---|---|
| 2014/0231464 | A1* | 8/2014 | Cho | B05B 11/0037 222/321.8 |
| 2016/0058154 | A1* | 3/2016 | Jung | A45D 34/00 222/382 |
| 2016/0242530 | A1* | 8/2016 | Son | A45D 34/04 |

FOREIGN PATENT DOCUMENTS

| | | | |
|---|---|---|---|
| KR | 10-2012-0040814 | | 4/2012 |
| KR | 10-1207314 | B1 | 12/2012 |
| KR | 10-1219009 | B1 | 1/2013 |

* cited by examiner

[Fig. 1]
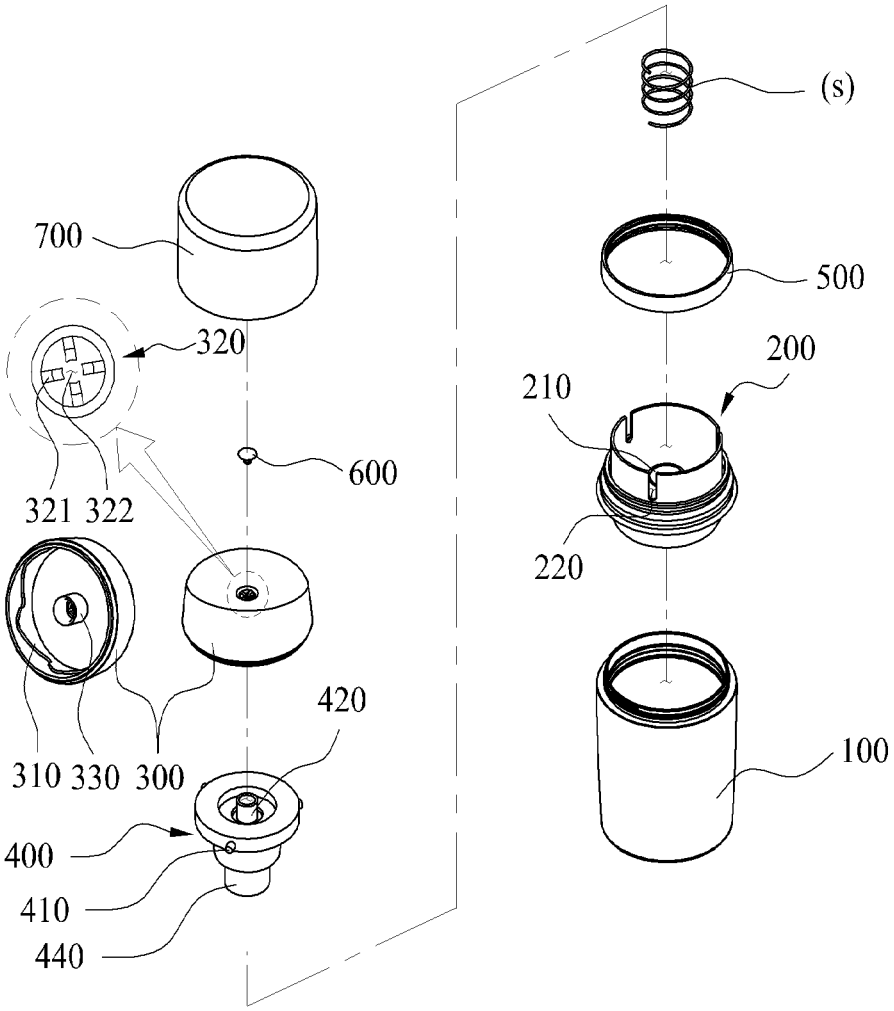

[Fig. 2]
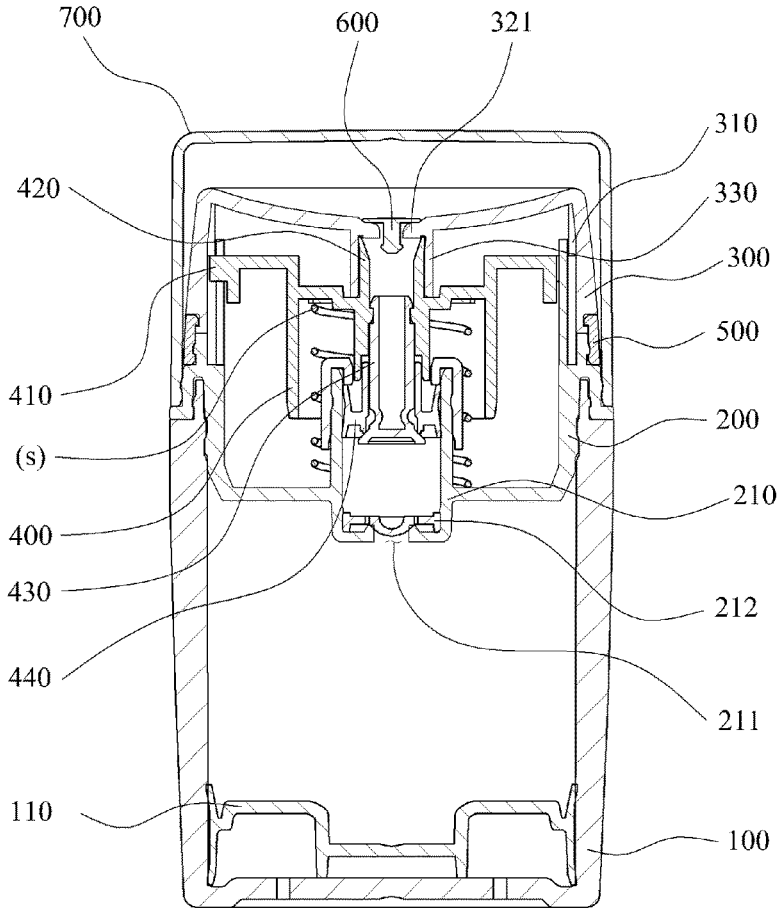
[Fig. 3]
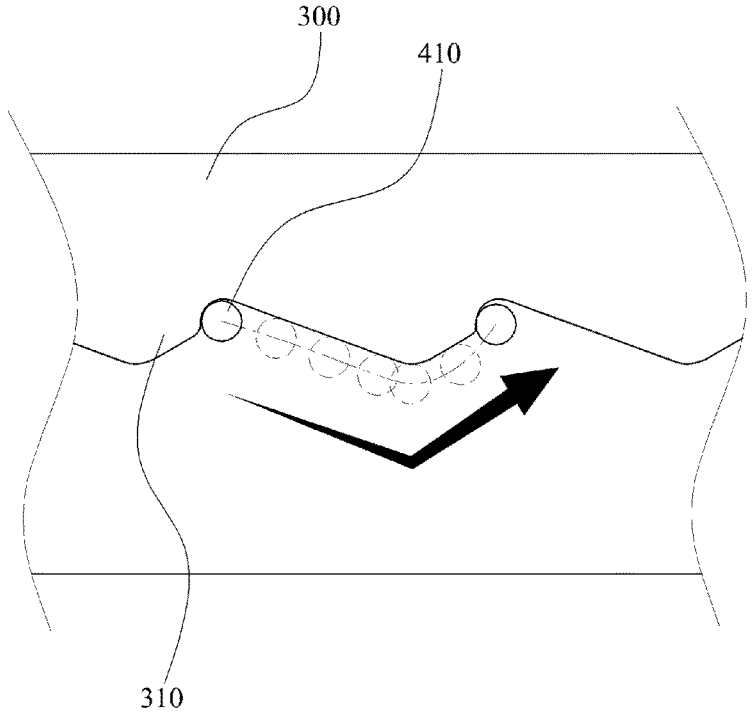

[Fig. 4]
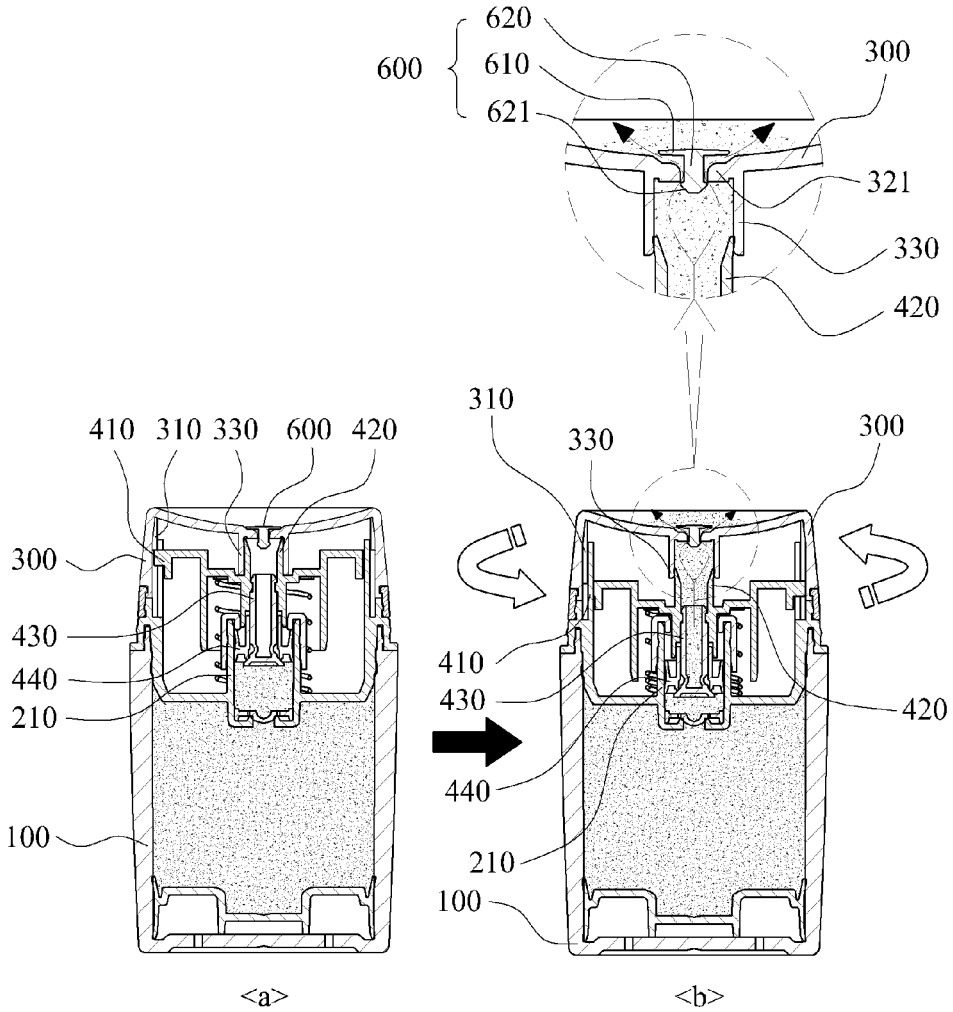

ROTARY DISPENSER-TYPE COSMETICS CONTAINER

CROSS-REFERENCE TO RELATED APPLICATIONS

This U.S. utility patent application is a national stage application under 35 U.S.C. §371 of international application PCT/KR2014/003715, filed Apr. 28, 2014, and claims the benefit of priority under 35 U.S.C. §119 of Korean Patent Application No. 10-2013-0057210, filed May 21, 2013, the entire contents of which are hereby incorporated herein by reference for all purposes.

TECHNOLOGICAL FIELD

The present disclosure relates to a rotary dispenser-type cosmetics container in which, when a button part rotates, guide protrusions move along a bottom surface of a pumping guide formed on an inner peripheral surface of a button part and then an ascending and descending member ascends and descends, whereby a pumping action is conducted. Therefore, the container presently described discharges contents in a fixed state in which the height of the button part is not changed, and is thereby capable of preventing contents from unnecessarily leaking caused by unintentionally pressing a button by means of an external pressure.

BACKGROUND

Generally, cosmetics containers having a function of discharging cosmetics have a structure wherein cosmetics are pumped by pressing a valve such as a CV valve.

However, in such a structure of those existing cosmetics containers, there arises a problem when cosmetics to be discharged have high viscosity. In other words, the problem is difficulty in use because considerably strong pressing is needed to discharge cosmetics with high viscosity.

Furthermore, to restore a valve to its original position after pumping, generally restoring force of a spring which is installed in a pump or attached at the exterior should be used. In this case, when high viscosity cosmetics are used, restoration of these springs does not go smoothly.

If increasing elasticity of the spring to resolve difficulty of restoring a valve, as much pressing force as the elasticity of the spring increases is required so that cosmetics should be discharged; therefore, it leads to further inconvenience in use.

To resolve these problems, registered patent no. 10-1219009 was proposed by the present inventor.

The registered patent has a feature in that, when a rotating collar 140 rotates, guide protrusions 162 are guided upwards and downwards in a state of keeping guide protrusions 162 positioned to sideway by a upper and lower guide grooves 123, and descends along a rotating guide groove 141, and therefore, a button 160 descends and presses the check valve 130, thereby discharging contents.

However, there arises a problem that since the registered patent has a structure wherein a button 160 ascends and descends when a rotating collar 140 rotates, a separated space is formed between the rotating collar 140 and the button 160 for the ascent and descent of the button 160, causing not only the button 160 to shake when the button 160 ascends and descends but foreign material to flow in and adhere, and thereby the problem arises that the button 160 does not work smoothly.

Furthermore, there arises another problem that when a button is pressed by external pressure in a bag, a rotation collar is rotated, and thereby results in unnecessary spilling of contents.

SUMMARY OF THE DISCLOSURE

The present disclosure is devised to solve the said problems above, and its goal is to provide a rotary dispenser-type cosmetics container in which, when a button part rotates, guide protrusions move along a bottom surface of a pumping guide formed on an inner peripheral surface of a button part and then an ascending and descending member ascends and descends, whereby a pumping action is conducted. Therefore, the presently described container discharges contents in a fixed state in which the height of the button part is not changed, and is thereby capable of preventing contents from unnecessarily leaking caused by unintentionally pressing a button by means of an external pressure.

To solve the above problems, it is featured that a rotary dispenser-type cosmetics container according to the present disclosure comprises a container body which contains contents, equipped with a piston that ascends according to the use of contents therein; a housing which is combined to the container body, comprising a contents inflow part which forms a contents inflow hole in the center of a lower end so that contents held in the container body may flow in, and forming a multitude of vertical guide grooves formed with fixed distance apart along an outer circumferential surface; a button part which is combined at an upper portion of the housing to be rotatable, comprising a rotation guide which is combined and forms a flexure portion upwards and downwards alternatively, encasing an inner circumferential surface, and a discharging hole on an upper portion of the button part where contents are discharged; and an ascending and descending member which ascends and descends by rotation of the button part, comprising a multitude of guide grooves which move along a bottom surface of the rotation guide in a state of being inserted into the vertical guide grooves at an outer circumferential surface and therein ascend and descend inside the vertical guide grooves.

Furthermore, it is featured that at an inner side of the ascending and descending member is combined a piston rod moving along the movement of the ascending and descending member, and at a lower portion of the piston is combined a seal cap which closely and tightly encases an inner circumferential surface of the content inflow part, thereby changing inner pressure of the contents inflow part according to the ascent and descent of the piston rod and guiding the contents held in the container body to the contents inflow part.

Furthermore, it is featured that the housing comprises a combining ring which makes the button part combined so as to be rotatable to the housing.

Furthermore, it is featured that at an inner side of the button part is equipped a combining tube which extends downwards, encasing the discharging hole, and guides a vertical movement of an ascending and descending member. At the ascending and descending member is equipped a contents movement tube which is combined to the combing tube, ascends and descends along an inner surface of the combining tube, and therein forms a passage where contents move.

Furthermore, it is featured that at the discharging hole is combined a nozzle tip which opens when contents are discharged, and at an inner circumferential surface are formed a multitude of support protrusions which form a nozzle-tip combining hole so as to support the nozzle tip.

Furthermore, it is featured that the nozzle tip comprises an opening and closing plate which covers an upper end of the discharging hole, and a support bar which extends from a center to an lower portion of the opening and closing plate, is combined to the nozzle-tip combining hole, and supports the opening and closing plate. Wherein at a lower portion of the support bar, the nozzle tip moves upward encasing an outer circumferential surface and forms a fixing protrusion.

Furthermore, it is featured that an upper end of the fixing protrusion is positioned, detached from a lower end of the support protrusion, and then moves to an upper portion by the pressure and meets to a lower end of the support protrusion when contents are discharged.

As mentioned above, the presently described embodiments have an advantage that when a button part rotates, guide protrusions move along a bottom surface of a pumping guide formed on an inner peripheral surface of a button part and then an ascending and descending member ascends and descends, whereby a pumping action is conducted. Therefore, the presently described container discharges contents in a fixed state in which the height of the button part is not changed, and is thereby capable of preventing contents from unnecessarily leaking caused by unintentionally pressing a button by means of an external pressure.

Furthermore, the presently described container has an advantage that when contents are discharged, a nozzle tip moves upwards by a narrow margin and then direction of discharging is changed by an opening and closing plate in a state of a discharging hole being opened, thereby resulting in a side way discharging. Additionally, it prevents contents from being discharged and shot abruptly.

BRIEF DESCRIPTION OF THE DRAWINGS

FIG. 1 is a perspective view illustrating a rotary dispenser-type cosmetics container according to an exemplary embodiment.

FIG. 2 is a cross-sectional view illustrating a configuration of the rotary dispenser-type cosmetics container according to an exemplary embodiment.

FIG. 3 is an explanatory drawing illustrating a moving state of guide protrusions of the rotary dispenser-type cosmetics container according to an exemplary embodiment.

FIG. 4 is an explanatory drawing illustrating the operational state of the rotary dispenser-type cosmetics container according to an exemplary embodiment.

DETAILED DESCRIPTION OF PREFERRED EMBODIMENTS

Hereinafter, exemplary embodiments will be described in detail with reference to the accompanying drawings. The same reference numerals provided in the drawings indicate the same members.

FIG. 1 is a perspective view illustrating a rotary dispenser-type cosmetics container according to an exemplary embodiment. FIG. 2 is a cross-sectional view illustrating a configuration of the rotary dispenser-type cosmetics container according to an exemplary embodiment. FIG. 3 is an explanatory drawing illustrating a moving state of guide protrusions of the rotary dispenser-type cosmetics container according to an exemplary embodiment.

Referring to FIGS. 1 to 3, a rotary dispenser-type cosmetics container according to an exemplary embodiment includes a container body 100, a housing 200, a button part 300, and an ascending and descending member 400.

The container body 100 that contains contents comprises a piston which ascends inside the container body according to the use of contents.

The housing 200, which is combined to an upper portion of the container body 1100 and sucks in contents contained in the container body 100 by pumping action according to the ascent and descent of an ascending and descending member 400, comprises a contents inflow part 210 which forms a contents inflow hole 211 at the center of a lower end of the housing 100 so that contents contained in the container body 100 may flow in.

At the contents inflow hole 211 is installed a check valve 212 which opens and closes a contents inflow part 210 by the pressure generated in the interior of the contents inflow part 210 when a piston rod 430 and a seal cap 440 ascend and descend inside the contents inflow part 210.

On the other hand, according to the present disclosure, at an outer circumferential surface of the housing 200 is longitudinally installed a vertical guide groove so that a guide groove 410 to be described later is inserted and guided upwards and downwards. The vertical guide grooves 220 are preferred to be installed in a way that three of the grooves are formed with a fixed distance apart in an interval of 120 degree as in FIG. 1 so as for an ascending and descending member 400 to function stably.

In the presently described embodiments, the vertical guide grooves 220 is viewed as three grooves are formed with a fixed distance apart in an interval of 120 degree; however, it is possible to install a variety of exemplary embodiments such as installing two of the grooves on both sides.

Meanwhile, an over cap 700, encasing a button part 300, is combined at an outer side of the housing 200 so as to be attached and detached easily.

The button part 300 is rotatably combined to an upper portion of the housing 200, comprising a discharging hole 320 on the upper end where contents are discharged.

At the discharging hole 320 is combined a nozzle tip 600 which opens when contents are discharged, wherein at an inner circumferential surface are installed a multitude of support protrusion 321 so as to support the nozzle tip 600, as protrusively forming a nozzle-tip combining hole 322 with a fixed distance detached. The multitude of the support protrusions 321 makes contents move upwards through a space separated with a fixed distance.

The nozzle tip 600 comprises an opening and closing plate 610 in a circular shape which is positioned in a state that a discharging hole 320 is closed when in ordinary condition and then positioned in a state that a discharging hole 320 is opened by the pressure of contents, and a support bar 620 which is extended from the center of a lower end of the opening and closing plate 610 and combined to the nozzle-tip combining hole 322, thereby supporting the opening and closing plate 610. It is desired that a fixing protrusion 621 should be installed, encasing an outer circumferential surface at a lower portion of the support bar 620, so as to prevent the nozzle tip 600 from moving upwards and being detached from a discharging hole 320.

An upper end of the fixing protrusion 621 is positioned, detached from a lower end of the support protrusion 321, and moves upwards by the pressure generated when contents are discharged, thereby meeting a lower end of the support protrusion 321. Therefore, contents are not discharged as an opening and closing plate 610 is being overturned upwards. Instead, contents moving upwards are discharged to a sideway by an opening and closing plate 610 in a state that a nozzle tip 600 moves upwards with as small a margin as a detached space between a support protrusion 321 and a fixing protrusion 621 and thereby opens a discharging hole 320, as a result, preventing contents from being shot outwards.

Furthermore, the nozzle tip 600 is closely contacted to an inner surface of a combining tube 330 and closes a discharging hole 320 when a contents movement tube 420 which ascends and descends, is ascending, thereby preventing contents discharged to an upper end of a button part 300 from being sucked to a contents movement tube 420.

Meanwhile, it is featured that at an inner surface of the button part 300 is installed a rotation guide 310 which forms a flexure portion upwards and downwards alternatively, encasing an inner circumferential surface. The rotation guide 310, as viewed in FIG. 3, guides the movement of guide protrusions 410 along a bottom surface when the button 300 rotates, wherein the guide protrusions 410 are descended by pressurization of the rotation guide 310 while the guide protrusions 410 are ascended by elastic force of springs.

Meanwhile, at an inner surface of the button part 300 is installed a combining tube 330 which encases the discharging hole 320, and extends downwards, wherein the combining tube 330 guides the movement of a contents movement tube 420 which moves along an inner wall of the combining tube 330, moving vertically without distortion when the ascending and descending member 400 ascends and descends.

Meanwhile, between the button part 300 and the housing 200 is installed a combining ring 500 which rotatably combines the button part 300 to the housing 200.

The ascending and descending member 400 is ascended an descended by rotation of the button part 300, and causes a pumping action for moving contents held in the container body 100 to the discharging hole 320, wherein at an inner surface is combined a piston rod 430 which moves along the movement of the ascending and descending member 400. And at a lower portion of the piston rod 430 is combined a seal cap 440 which closely encases an inner circumferential surface of the contents inflow part 210 and changes the pressure of an interior of the contents inflow part 210 by the ascent and descent of the piston rod 430 and guides contents held in the container body 100 to flow into the interior of the contents inflow part 210.

It is featured that at an outer circumferential surface of the ascending and descending member 400 are installed a multitude of guide protrusions 410 which move along a bottom surface of the rotation guide 310 in a state of being inserted into the vertical guide groove 220 and ascend and descend inside the vertical guide groove 220. The guide protrusions 410 are pressed by the surface of the rotation guide 310 when the button part 300 rotates, and then moves downwards inside of the vertical guide groove 220, and thereby, descends the ascending and descending member 400, making it possible that contents flowing into the contents inflow part 210 can move to an upper portion according to the change of pressure of the contents inflow part 210; meanwhile, when pressurization by the rotation guide 310 is released, in other words, when the guide protrusions 410 move up from the lowest point of the flexure portion formed alternatively, the guide protrusions 410 ascend along a bottom surface of the rotation guide 310 by elastic force of springs and moves upwards inside the vertical guide groove 220, thereby ascending the ascending and descending member 400 and making it possible that contents held in the container body 100 can be sucked into a contents inflow part 210 according to the change of pressure of the contents inflow part 210.

Meanwhile, at the ascending and descending member 400 is combined a contents movement tube 420 which is combined to the combining tube 330 and ascends and descends along an inner wall of the combining tube 330, therein forming a passage where contents move.

In the following, referring to FIG. 4, an operational procedure of a rotary dispenser-type cosmetics container according to an exemplary embodiment will be explained. FIG. 4 is an explanatory drawing illustrating an operational state of a rotary dispenser-type cosmetics container according to an exemplary embodiment.

Referring to FIG. 4, as for a rotary dispenser-type cosmetics container according to an exemplary embodiment, when a user rotates a button part 300 in a state that contents flow into the interior of a contents inflow part 210, guide protrusions 410 of an ascending and descending member 400 move along a rotation guide 310 formed at an inner surface of the button part 300; at this moment, due to the shape of the rotation guide 310, the guide protrusions 410 move downwards inside the vertical guide groove 220 as descending the ascending and descending member 400.

When the ascending and descending member 400 descends as the above, the pressure inside the contents inflow part 210 changes as a piston rod 430 and a seal cap 440 descend together, which leads contents flowing into the contents inflow part 210 is discharged through a contents movement tube 420; at the moment, contents moving upwards move to a sideway by an opening and closing plate 610, in a state that a nozzle tip 600 moves upwards with as small a margin as a detached space between a support protrusion 321 and a fixing protrusion 621 and thereby opens a discharging hole 320, and are discharged at an upper end of the button part 300.

In the presently described embodiments, contents are not discharged directly to a upward direction, but to a sideway after the discharging direction is changed by an opening and closing plate 610 in a state that a nozzle tip 600 moves upward with a small margin and firstly opens a discharging hole 320, and therefore prevents contents from being shot abruptly.

As described above, optimal embodiments have been disclosed in the drawings and the specification. Although specific terms have been used herein, these are only intended to describe the disclosed embodiments and are not intended to limit the meanings of the terms or to restrict the scope recited in the accompanying claims. Accordingly, those skilled in the art will appreciate that various modifications and other equivalent embodiments are possible from the above embodiments. Therefore, the scope of the present invention should be defined by the technical spirit of the accompanying claims.

What is claimed is:

1. A rotary dispenser-type cosmetics container comprising:

a container body wherein contents are held, further comprising a piston which ascends inside the container body according to the use of contents;

a housing which is combined to an upper portion of the container body, further comprising a contents inflow part forming a contents inflow hole at the center of a lower end of the housing so that contents contained in the container body flow in, and a multitude of vertical guide grooves formed along an outer circumferential surface with a fixed distance apart;

a button part combined to an upper portion of the housing to be rotatable, further comprising a rotation guide which forms a flexure portion upwards and downwards alternatively encasing an inner circumferential surface, and a discharging hole where contents are discharged on an upper end; and an ascending and descending member which is ascended and descended by rotation of the button part, comprising a multitude of guide protrusions which move along a bottom surface of the rotation guide in a state of being inserted into the vertical guide groove and ascend and descend inside the vertical guide groove;

wherein at an inner surface of the button part is installed a combining tube which encases the discharging hole, thereby guiding the vertical movement of an ascending and descending member, and wherein at the ascending and descending member is combined a contents movement tube which is combined to the combining tube and moves along an inner wall of the combining tube, forming a passage where contents move.

2. The rotary dispenser-type cosmetics container of claim 1, wherein at an inner surface of an ascending and descending member is combined a piston rod which moves along together with movement of the ascending and descending member, and wherein at a lower portion of the piston rod is combined a seal cap which closely encases an inner circumferential surface of the contents inflow part, thereby changing the pressure of an interior of the contents inflow part according to the ascent and descent of the piston rod and guiding contents held in the container body to flow into the interior of the contents inflow part.

3. The rotary dispenser-type cosmetics container of claim 1, further comprising a combining ring which combines the button part to the housing so as to be rotatable.

4. The rotary dispenser-type cosmetics container of claim 1, wherein at the discharging hole is combined a nozzle tip which is opened when contents are discharged, and at an inner circumferential surface of the discharging hole a multitude of support protrusions form a nozzle-tip combining hole and are protrusively combined with a fixed distance detached so as to support the nozzle tip.

5. The rotary dispenser-type cosmetics container of claim 4, wherein the nozzle tip comprises an opening and closing plate which covers an upper end of the discharging hole, and a support bar which is extended from the center to the lower portion of the opening and closing plate and combined to the nozzle-tip combining hole, thereby supporting the opening and closing plate, and wherein at a lower portion of the support bar is installed a fixing protrusion which encases an outer circumferential surface at a lower portion of the support bar, so as to prevent the nozzle tip from moving upwards and thereby being detached from the discharging hole.

6. The rotary dispenser-type cosmetics container of claim 5, wherein an upper end of the fixing protrusion is positioned, detached from a lower end of the support protrusion, and then moves upwards by the pressure generated when contents are discharged, thereby meeting a lower end of the support protrusion.

* * * * *